United States Patent [19]

Browning

[11] 3,965,448

[45] June 22, 1976

[54] WAVEGUIDE ISOLATOR WITH DAMPING MEANS

[75] Inventor: Wayne L. Browning, Costa Mesa, Calif.

[73] Assignee: The United States of America as represented by the Secretary of the Navy, Washington, D.C.

[22] Filed: May 7, 1975

[21] Appl. No.: 575,305

[52] U.S. Cl. ..... 333/98 R; 333/95 A

[51] Int. Cl.[2] ..... A44B 21/00

[58] Field of Search ..... 333/98 R, 98 M, 98 A; 138/106

[56] References Cited

UNITED STATES PATENTS

| | | | |
|---|---|---|---|
| 3,602,960 | 9/1971 | Urbigkeit | 333/98 |
| 3,703,690 | 11/1972 | Ravenscroft et al. | 333/98 M |

*Primary Examiner*—Alfred E. Smith
*Assistant Examiner*—David K. Moore
*Attorney, Agent, or Firm*—R. Sciascia; R. Beers; S. Sheinbein

[57] ABSTRACT

An isolator for enclosing a flexible waveguide at an antinode point along its length to attenuate movement of the waveguide and prevent its reaching a resonant condition, the isolator comprising a thick band of metallic wool impregnated with a low-density rubber foam contained within an elastomer jacket and supported by a snugly fitting bracket around its outer circumference which is firmly attached to a relatively immobile foundation.

It should be understood that the foregoing abstract of the disclosure is for the purpose of providing a non-legal brief statement to serve as a searching-scanning tool for scientists, engineers and researchers and is not intended to limit the scope of the invention as disclosed herein nor is it intended that it should be used in interpreting or in any way limiting the scope of fair meaning of the appended claims.

11 Claims, 4 Drawing Figures

WAVEGUIDE ISOLATOR WITH DAMPING MEANS

BACKGROUND OF THE INVENTION

1. Field of Invention

The present invention relates generally to damping devices and in particular to a means for protecting and damping flexible waveguides that are exposed to dynamic environments.

2. Description of the Prior Art

Waveguides are generally employed to transmit microwave energy signals between various components of a microwave system. When there is relative motion between these electronic components, the waveguides must be flexible in order to accommodate any misalignments caused by this movement.

Relative movement between electronic components is especially severe on board Naval weapon-carrying vessels. Typically, electronic systems are enclosed in isolator cabinets which are especially designed to isolate the electronic components contained therein from the high shock and vibration levels caused by the firing of heavy deck guns and rockets. These cabinets effect this isolation by translating severe shocks into a series of much smaller vibrations. Thus, flexible waveguides must clearly be utilized to transmit the microwave signals between these isolator cabinets.

A basic problem arises from the use of flexible waveguides in this type of environment in that, as the waveguide moves and vibrates with the cabinet, the flexibility of the waveguide actually serves to amplify these cabinet vibrations within the waveguide. Thus big cabinet excursions may become sufficiently amplified by the waveguide structure to cause waveguide cracking and fatiguing at the waveguide flanges.

This type of waveguide-shell vibration must be attenuated in order to give the waveguide a reasonable operational life. Yet, it is clear from the above discussion that this requirement of attenuation of waveguide-shell vibrations and the translation requirement of the electronic cabinets needed for shock isolation are mutually exclusive.

SUMMARY OF THE INVENTION

The present invention solves the before-mentioned problems by providing a waveguide isolator which may be fitted over and around the waveguide at an antinode point or various points along its length to control and damp waveguide vibration and prevent the development of a resonant condition in the waveguide walls. The device comprises a flexible isolating center-section capable of providing a frictional dissipation of energy and which is supported around a waveguide by a bracket which is secured to a relatively immovable object.

OBJECTS OF THE INVENTION

An object of the present invention is to protect and control a flexible waveguide exposed to dynamic environments.

A further object is to prevent the confining walls of a flexible waveguide from attaining a resonant condition in a dynamic environment.

A still further object is to attenuate vibration in a flexible waveguide in a high-shock environment while permitting large excursions of the electronic isolating cabinets at the ends of the waveguide.

Other objects, advantages and novel features of the present invention will become apparent from the following detailed description of the invention when considered in conjunction with the accompanying drawing.

DETAILED DESCRIPTION OF THE INVENTION

Figure 1A:
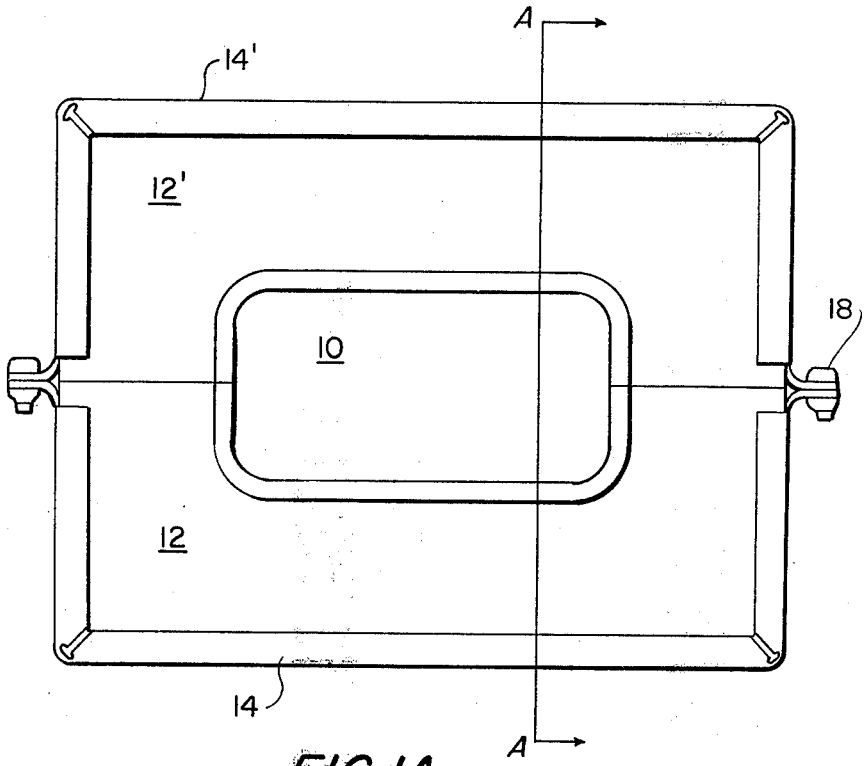
FIG. 1*a* is a front view of the isolator assembly of the present invention.
Figure 1B:
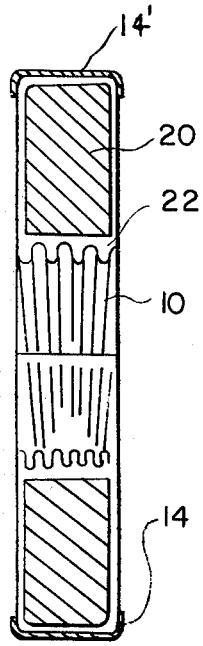
FIG. 1*b* is a sectioned side-view of the assembly shown in FIG. 1 taken along the line A—A.

FIGS. 1*a* and 1*b*, show two substantially rectangular blocks 12 and 12' of flexible material capable of frictionally dissipating energy when flexed. These blocks are molded to fit around a waveguide 10. (The waveguide walls or convolutions are not actually shown in the figures). The blocks of material 12 and 12' are supported by snugly fitting metal brackets 14 and 14' wrapped around the outer perimeter of the blocks 12 and 12' respectively and held tightly together by the two bracket fasteners 18.

The material 12 used for frictional energy-dissipation may be a thickly intertwined mesh 20 of flexible strands impregnated with a low-density foam. This impregnated mesh 20 is supported around the flexible waveguide 10 by an elastomeric jacket 22.

The particular embodiment of this invention actually constructed utilized type 430, stainless, coarse-grade, steel wool impregnated with RTV rubber foam at a density of 10 pounds/cubic foot. Any type of metallic wool is clearly suitable though, preferably, it should be non-corrosive. The actual density of the foam used is also not critical though it should be sufficiently low so that the mesh 20 can be impregnated therewith.

Figure 2:
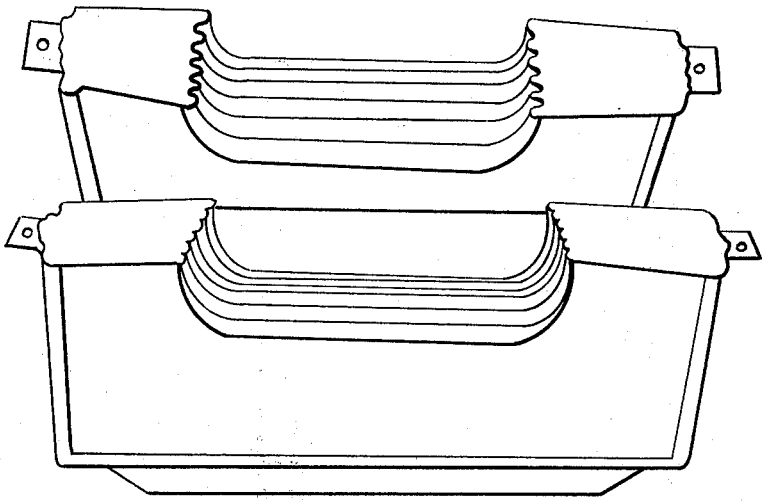
FIG. 2 is a perspective view of the two halves forming the isolator assembly of the present invention.

The elastomeric jacket 22 functions to hold the impregnated wool 20 in place uniformly around the waveguide outer shell. It must be pliable so that the waveguide can move within the isolator. The jacket may be molded to fit the shell designs of most waveguides. For example, the jacket shown in FIGS. 1*b* and 2*b* is molded to fit a corrugated flexible waveguide. Such specially molded jackets have the advantage of holding the isolator to the waveguide and preventing the isolator from moving laterally along the waveguide.

Figure 3:
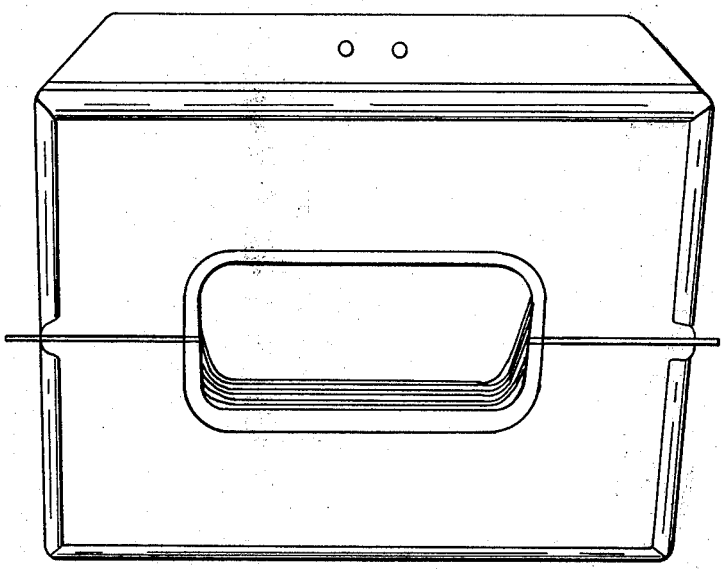
FIG. 3 is a perspective view of the bolted isolator-halves.

Typically, the blocks 12 may be formed as follows. Each block is made in approximately the shape of a C. A metallic mold is made to fit the waveguide to be enclosed. The steel wool is placed in this mold. Then low-density rubber foam is injected under pressure through a hole in the mold into the steel wool. This impregnated steel wool is cured for the required period (usually 30 to 60 minutes) and is then removed from the metal mold and placed within the specially molded jacket 22 and the top of the jacket 22 is molded to completely seal the steel wool in place. This jacketed, impregnated steel-wool 12 is then placed within an aluminum bracket 14. The two C shaped sections thus formed are illustrated in perspective in FIG. 2. A perspective view of the completed structure properly bolted together is shown in FIG. 3.

The completed isolator may be located anywhere along the length of the waveguide. Generally, vibration amplification by a waveguide is significant when the waveguide length approximates a resonant length which is of course determined by the size of the waveguide. Thus, in order to significantly attenuate the waveguide movement and to prevent the attainment of a resonant condition the isolator should be attached at the antinode or antinodes of the waveguide (which are a function of the waveguide length). Typically, this results in a placement of the isolator at mid-span of the waveguide.

Once the isolator is properly positioned along the waveguide length, it must be anchored to a relatively immobile foundation in order to effect the proper damping. On shipboard the isolator is usually bolted to an outward projection of the bulkhead. Additional flanges may be welded to the bracket 14 to facilitate this anchoring or the flanges for the bracket fasteners 18 may be utilized for this purpose.

In a high-shock environment the isolator operates as follows. As the waveguide moves within the essentially rigid confines of the bracket 14, the jacketed steel-wool padding 12 is flexed by the waveguide. This flexure produces an internal friction within the padding 12 which effectively damps the waveguide movement and dissipates its energy.

It should be noted that a relatively snug isolator-waveguide fit is preferred in order to confine all of the isolator movement to the steel wool padding 12. Thus, the bracket 14 should be tightened so that there is no movement at the bracket 14 - padding 12 interface.

Obviously, many modifications and variations of the present invention are possible in light of the above teachings. It is therefore to be understood that, within the scope of the appended claims, the invention may be practiced otherwise than as specifically described.

What is claimed is:

1. A waveguide isolator for attenuating the vibrations of a flexible waveguide comprising:

flexible isolator means capable of enclosing a section of waveguide wall at a proper point along the length of said waveguide to support it to attenuate waveguide vibration and thus prevent a resonant condition, said isolator means being formed from a material which frictionally dissipates energy when flexed, said material comprising a thickly intertwined material impregnated by a low-density flexible foam and an elastic jacket supporting said foam-impregnated material; and bracket means supporting said isolator means, said bracket means being adapted to be coupled to a relatively immobile foundation so that movement of said waveguide flexes the energy dissipation material of said isolator means within the confines of the relatively immobile bracket means thereby dissipating the movement of said waveguide walls.

2. A waveguide isolator as defined by claim 1, wherein said thickly intertwined material is metalic wool.

3. A waveguide isolator as defined by claim 1, wherein said low-density flexible foam is rubber foam.

4. A waveguide isolator as defined by claim 1, wherein said bracket means is an aluminum bracket.

5. A waveguide isolator as defined by claim 1, wherein said bracket means and said flexible isolator means are made in the shape of two C's which may be fitted around a waveguide and locked together.

6. A waveguide isolator as defined by claim 1 wherein said thickly intertwined material is stainless steel wool.

7. A waveguide isolator as defined in claim 1 wherein said elastic jacket completely encloses the foam impregnated thickly intertwined material whereby the elastic jacket provides a contacting surface with the enclosed waveguide wall.

8. A waveguide isolator as defined in claim 7 wherein said elastic jacket is corregated along said contact surface with the waveguide wall.

9. A waveguide isolator as defined in claim 1 wherein said flexible isolator is located at an antinode point on said waveguide.

10. A method for attenuating the movement of a waveguide in a dynamic environment comprising the steps of:

forming a flexible isolator to dissipate energy when flexed by:

impregnating metallic wool with a low density rubber foam, jacketing said impregnated metallic wool with an elastomer covering, fitting a bracket snugly around the outer perimeter of said elastomer covering;

enclosing a section of waveguide within said waveguide isolator at a proper point along the length of said waveguide to support it to attenuate waveguide vibration and thus prevent the attainment of a resonant condition; and rigidly attaching said bracket to a relatively immobile foundation so that movement of said waveguide flexes said material within the confines of the relatively immobile bracket thereby dissipating the movement of the waveguide therein.

11. A method as defined by claim 10, wherein said waveguide is enclosed by said energy-dissipating material at an antinode point on said waveguide.

* * * * *